United States Patent [19]

Sakuma et al.

[11] Patent Number: 4,465,991

[45] Date of Patent: Aug. 14, 1984

[54] OPERATING DEVICE FOR EFFECTING OPENING AND CLOSING OPERATION OF A VACUUM INTERRUPTER WITH AN ELECTROMAGNET INCORPORATED THEREIN

[75] Inventors: Shinzo Sakuma, Yokohama; Hifumi Yanagisawa, Sagamihara; Kazuo Tokuhata, Yamanishi; Hiroshi Miyagawa, Yokohama, all of Japan

[73] Assignee: Kabushiki Kaisha Meidensha, Tokyo, Japan

[21] Appl. No.: 483,157

[22] Filed: Apr. 8, 1983

Related U.S. Application Data

[62] Division of Ser. No. 215,855, Dec. 12, 1980, Pat. No. 4,429,197.

[30] Foreign Application Priority Data

Dec. 15, 1979 [JP] Japan ..... 54-163851

[51] Int. Cl.[3] ..... H01H 45/06

[52] U.S. Cl. ..... 335/151

[58] Field of Search ..... 335/151, 154; 200/144 B

[56] References Cited

U.S. PATENT DOCUMENTS 3,562,682 2/1971 Ohwada ..... 335/151

4,039,984 8/1977 De Lucia et al. ..... 335/151

*Primary Examiner*—Harold Broome

*Attorney, Agent, or Firm*—Lowe, King, Price & Becker

[57] ABSTRACT

An operating device for effecting opening and closing operation of a vacuum interrupter with an electromagnet incorporated therein comprises a supporting resin block (4) for supporting a vacuum interrupter, a first pair of poles (47*a*) and a second pair of poles (47*b*), both extending along the outer circumferential surface of the supporting resin block (4), the length of the first pair being longer than that of the second pair. The operating device further comprises a mounting plate (49) of magnetic material directly connected to the first pair and connected to the second pair through connecting rod means, and an electromagnet (52, 56) fastened to the mounting plate (49), supported by the first and second pairs and connecting rod means (57). Thus, the supporting arrangement for supporting a vacuum interrupter not only serves as a mechanically supporting member, but also does a magnetic path defining member.

2 Claims, 3 Drawing Figures

OPERATING DEVICE FOR EFFECTING OPENING AND CLOSING OPERATION OF A VACUUM INTERRUPTER WITH AN ELECTROMAGNET INCORPORATED THEREIN

BACKGROUND OF THE INVENTION

This is a division of application Ser. No. 215,855 filed 12/12/80, now U.S. Pat. No. 4,429,197.

The present invention relates to an operating device for effecting opening and closing operation of a vacuum interrupter with an electromagnet incorporated therein, and more particularly to an operating device for use with a vacuum interrupter designed so that an electromagnetic operating unit is incorporated in a vacuum interrupter.

There have been proposed various kinds of vacuum interrupters. The vacuum interrupter are roughly classified into two types.

One type thereof comprises a vacuum vessel essentially consisting of a cylindrical insulating envelope, and a pair of metallic end plates hermetically brazed to the respective axial ends of the envelope, and separable electrical contacts provided within the vacuum vessel through a pair of contact rods so that one is in contact with the other or away therefrom.

The other type comprises a vacuum vessel essentially consisting of a bell-shaped metal casing, and an insulating end plate of ceramics hermetically brazed to the opening end of the metal casing, and the same contact arrangement as stated in the above-mentioned type.

In either of types, the vacuum interrupter requires an operating device for operating a movable contact rod in the axial direction thereof so as to bring the vacuum interrupter into an interrupted condition or a contacts-closed condition.

For instance, U.S. Pat. No. 3,562,682 patented Feb. 9, 1971 teaches an example of an operating device for effecting opening and closing operation of a vacuum interrupter with an electromagnet. According to this prior art, there is disclosed a vacuum switching apparatus comprising a vacuum interrupter, and an electromagnet type operating unit for operating the switching apparatus wherein both members are independently fastened to a frame, such as, a board plate. That is, the vacuum interrupter is not incorporated with the operating unit as one unit. Accordingly, the operating unit requires a housing or a frame for mounting the electromagnet, with the result that an additional mounting step is required and/or the vacuum interrupting device becomes large-sized.

SUMMARY OF THE INVENTION

With the above in mind, an object of the present invention is to provide an operating device for operating a vacuum interrupter with an electromagnet incorporated therein, wherein an operating unit for effecting opening and closing operation of a vacuum interrupter is incorporated or integrally combined with the vacuum interrupter.

Another object of the present invention is to provide an operating device for operating a vacuum interrupter with an electromagnet incorporated therein making it possible to eliminate the step required for assembling the operating device into the vacuum interrupter unit, and to make the vacuum interrupting device small-sized.

Another object of the invention is to provide an operating device for operating a vacuum interrupter with an electromagnet incorporated therein wherein a supporting arrangement for supporting a vacuum interrupter not only serves as a mechanically supporting member, but also does a magnetic path defining member.

As one aspect of the invention, there is provided an operating device for effecting opening and closing operation of a vacuum interrupter with an electromagnet incorporated therein comprising: (a) a supporting resin block for supporting a vacuum interrupter wherein separable contacts are disposed within a vacuum vessel, (b) a first pair of poles and a second pairs of poles extending along the outer circumferential surface of the supporting resin block wherein the length of the first pair of poles is longer than that of the second pair of poles, and the poles constituting the pair have a diagonal relationship, (c) a mounting plate of magnetic material directly connected to the first pair of poles and connected to the second pair of poles through connecting rod means, and (d) an electromagnet comprising a core member and a winding wounded on the core member fastened to the mounting plate, supported by the first and second pairs of poles and connecting rod means, whereby a magnetic path is defined by the core member, the mounting plate and the connecting rod means.

As the other aspect of the invention, the operating device further comprises an armature member of magnetic material for actuation by the electromagnet wherein the armature member is supported by an insulating rod axially joined to the movable contact rod, and the arrangement being such that the armature member is in contact with or away from the electromagnet in accordance with the energized and de-energized conditions of the electromagnet to bring the vacuum interrupter into an interrupted condition or a contact-closed condition.

BRIEF DESCRIPTION OF THE DRAWINGS

The present invention can be more fully understood from the following detailed description when taken in connection with reference to the accompanying drawings, in which.

In these drawings, same reference numerals denote same or similar parts of the operating device of the invention.

DETAILED DESCRIPTION OF THE PREFERRED EMBODIMENT

Figure 1:
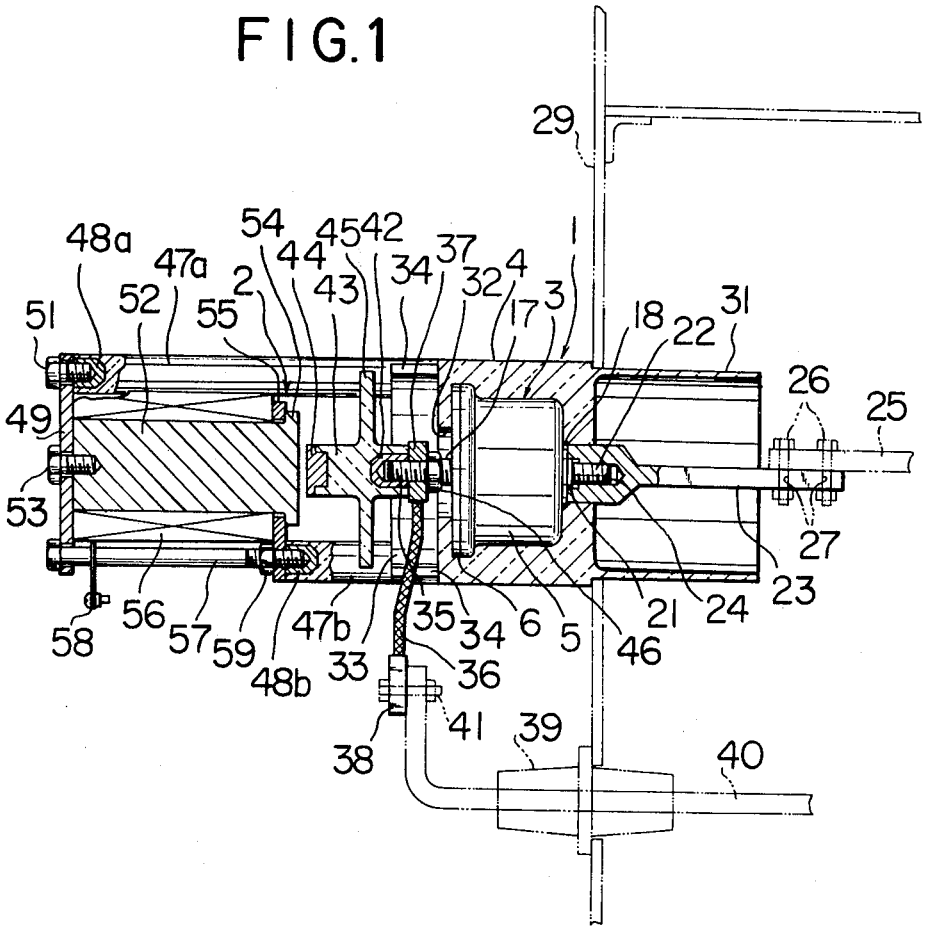
FIG. 1 is a longitudinal cross sectional view illustrating a vacuum interrupting device including an electromagnetic operating device for operating a vacuum interrupter according to the present invention.

Referring to FIG. 1, there is shown a vacuum interrupting device applicable to the present invention.

The vacuum interrupter essentially consists of an interrupting unit 1 constituted by molding a vacuum interrupter, and an operating unit 2 provided integrally concentrically with the interrupting unit 1 in order to effect an interrupting actuation.

More particularly, the interrupting unit 1 comprises a bell shaped vacuum interrupter 3, and a supporting block 4 of resin constituted by molding the vacuum interrupter 3.

Figure 3:
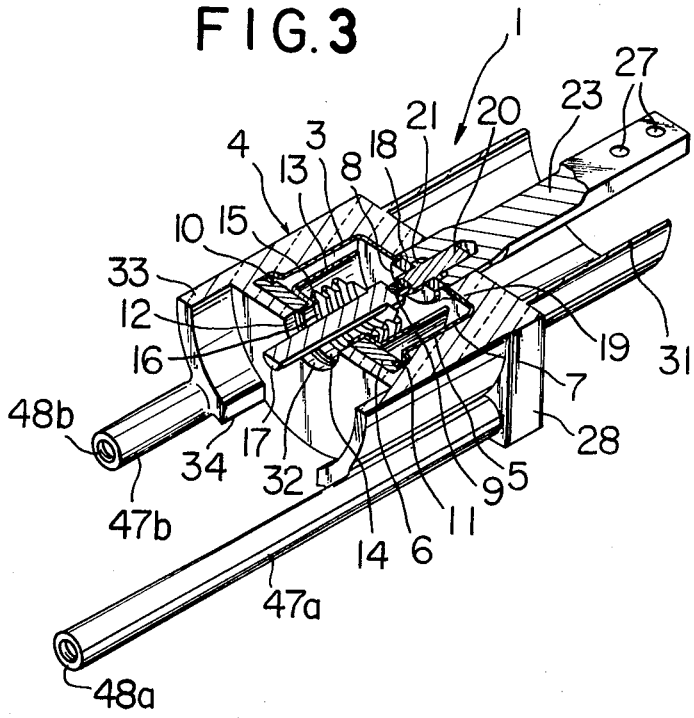
FIG. 3 is a perspective view partly in cross section of the interrupting unit shown in FIG. 1.

Referring to FIG. 3, there is shown the bell shaped vacuum interrupter 3. Reference numeral 5 denotes a bell shaped metal casing, 6 an insulating circular end plate, 7 a vacuum vessel constituted by the metal casing 5 and the end plate 6, respectively. Within the vacuum vessel 7, there are provided stationary and movable electrical contacts 8 and 9 so that the latter is movable relative to the former. Reference numeral 10 denotes a radially extended portion provided in the vicinity of the opening end of the metal casing 5. The metal casing 5 is fitted over the insulating end plate 6 so that the opening periphery of the extended portion 10 is hermetically brazed to a step portion 11. Reference numeral 12 denotes a bore provided in the center of the insulating end plate 6, 13 a cylindrical arc-shield member concentrically with the center of the vacuum vessel 7, 14 an annular fitting portion extending outwardly in the axial direction from the opening periphery of the center of the bore 12, 15 a bellows accommodated within the vacuum vessel 7, and 16 a tubular portion extending outwardly in the axial direction, respectively. Further, referring to the vacuum vessel 7, reference numerals 17 and 20 denote movable and stationary contact rods, respectively.

A circular auxiliary metal fitting 18 serving as an electricity collecting member is fitted into the bore provided in the bottom portion of the metal casing 5 through a fitting portion 19 projected from the circumferential surface of the auxiliary metal fitting 18 and is hermetically brazed thereto.

A stationary electric current conducting rod 23 which is connected to a electric power source or a load (not shown) is connected to the auxiliary metal fitting 18 in order to improve current collecting efficiency. The stationary electric current conducting rod 23 will be called "a stationary lead" hereinafter. The detail of the stationary lead will be described later. The auxiliary metal fitting 18 is made of Cu or Cu alloy. The stationary contact rod 20 having an electrical contact 8 on the extended end thereof is inserted in the central portion of the auxiliary metal fitting 18. More particularly, the stationary contact rod 20 is supported at the flange 21 by the auxiliary metal fitting 18 and is hermetically brazed thereto.

The stationary contact rod 20 is made of such as, Cu or Cu alloy which is the same material as that of the movable contact rod 17. The stationary lead 23 which is rectangular shaped in cross section is joined to the stationary contact rod 20 so that a screw portion 22 (see FIG. 1) provided on the stationary contact rod 20 is screw-threadedly connected to a screwed bore 24 provided in the stationary lead 23. More particularly, the stationary lead 23 is mounted on the stationary contact rod 20 so that the end surface thereof is in contact with the surface of the auxiliary metal fitting 18, thereby making it possible to obtain a large contact surface between the stationary lead 23 and stationary contact rod 20.

The stationary lead 23 is provided at an upwardly extended portion thereof with a plurality of holes 27 into which a clamping tool 26, such as bolt or nut for connecting an electrically connecting conductor 25 is engaged. Thus, the interrupting unit 1 is connected to the power-board due to the engagement between the stationary lead 23 and a connecting conductor 25 provided within the power-board.

The vacuum interrupter 3 is so called a self-closing type characterized in that the movable electrical contact 9 is in contact with the stationary electrical contact 8 in a normal condition due to the pressure differentials between the inside of the vacuum vessel and the outside thereof, and an elasticity of the bellows 15.

The outer circumferential portion of the vacuum interrupter 3 together with the one end of the stationary lead 23 screw-threadedly connected to the stationary contact rod 20 is molded by the supporting block 4. In the supporting block 4, a rectangular shaped flange 28 is provided integrally at the bottom portion of the metal casing 5. In the vicinity of the rectangular portion of the flange 28, a metal fitting 30 with a screw hole (see FIG. 2) is embedded, which is used when mounting a molded vacuum interrupter 3 to a board wall 29 of the power-board as shown in FIG. 1.

The flange 28 is integrally formed with a cylindrical or tubular stationary insulating barrier 31 which concentrically surrounds the stationary lead 23. One object of the provision of the stationary insulating barrier 31 is to insulate the stationary lead 23 with respect to the board wall 29 of which electrical potential is earth potential. The other object thereof is to insulate between different phases when using the vacuum power interrupter for use in two or three phases.

The vacuum interrupter 3 is attached to the board-plate so that the stationary insulating barrier 31 is inserted in the board wall 29. Actually, a clamping tool (not shown) is screw-threadedly connected to metal fitting portions 30 (see FIG. 2) provided in the flange 28 to establish the connection between the vacuum interrupter 3 and the board wall 29.

Thus, the vacuum power interrupting device makes it possible to provide a construction serving as a bushing comprising the stationary lead 23 and the insulating barrier 31 surrounding the stationary lead 23 concentrically therewith.

There is provided a bore 32 for projecting a movable contact rod 17 at the position communicating with the bore 12 (see FIG. 3) provided in the insulating circular end plate 6. The supporting block 4 is provided at the peripheral edge thereof on the side of the insulating circular end plate 6 with a cylindrical insulating barrier 33 surrounding the movable contact rod 17 projected through the bore 32. The insulating barrier 33 is provided for effecting an insulation between different phases when using the vacuum power interrupter for use in two or three phases. The insulating barrier 33 is provided at the annular portion of which symmetric axis corresponds to the movable contact rod 17 with a plurality of rectangular shaped recesses 34 for permitting a movable electrode (which will be described later) to be conducted thereinto.

The movable contact rod 17 projects in such an extent that the extending length thereof is the same as the extending length in the axial direction of the insulating barrier 33. The movable contact rod 17 is provided at the outwardly extended portion thereof with a screw portion 35. The one end of flexible lead conductor 36 is connected to the screw portion 35 of the movable contact rod 17 in such a manner that a ring shaped connecting metal fitting 37 provided at the one end of the flexible lead conductor 36 is fitted over the screw portion 35. The other end of the lead conductor 36 is electrically connected to a connecting conductor 40 extracted from the board wall 29 through a bushing 39 by means of a clamping tool 41 such as bolt or nut.

Further, an insulating rod 43 of resin at the one end of which a metal fitting 42 is embedded is screw-threadedly connected to a screw portion 35 of the movable contact rod 17. On the other end of the insulating rod 35, an armature member 44 is embedded. The insulating rod 43 is provided for insulating between the movable contact rod 17 and the actuating unit 2 of which detail will be referred to later. The insulating rod 43 is integrally formed in the middle portion thereof with a flange 45 for increasing the creeping surface withstanding voltage.

The insulating rod 43 makes it possible to adjust a relative position with respect to the movable contact rod 17, that is, a gap formed between the end of the iron core 52 of the operating unit 2 and the insulating rod 43 by rotating it in the suitable direction. The insulating rod 43 is fixed at a desired position by means of a lock nut 46 adapted to be screw-threadedly connected to the screw portion 35 of the movable contact rod 17 so as to clamp the connecting metal fitting 37 provided on the end of the lead conductor 36.

Along the outer circumferential surface of the supporting block 4, there are provided a plurality of supporting poles 47*a* and 47*b* (each of which length is different to each other) extending in the moving direction of the movable contact rod 17. The number of the poles is four in the embodiment. On each end thereof, metal fittings 48*a* and 48*b* are embedded. The supporting poles 47*a* and 47*b* are provided for mounting the actuating unit 2 comprising an electromagnet for effecting the opening and closing operation of the interrupting unit 1 so that the operating unit 2 is disposed concentrically with the interrupting unit 1. On the end portion of the supporting pole 47*a*, a rectangular shaped mounting plate 49 constituting a part of the operating unit 2 is mounted by means of a clamping tool 51 screw-threadedly joined into a metal fitting 48*a* through a plurality of holes 50 provided in the vicinity of the corner thereof.

The mounting plate 49 constitutes a magnetic path forming unit, together with a connecting member which will be described later. The mounting plate 49 is made of a magnetic material, such as an iron. On the central portion thereof, the bottom portion of an iron core 52 of the electromagnet disposed concentrically with the movable contact rod 17 and the insulating rod 43 is integrally mounted by means of a clamping tool 53. The top portion of the iron core 52 is disposed so as to oppose the armature 44. On the axial end thereof, a flange 54 is integrally mounted. On the side of the top end of the iron core 52, a winding supporting member 55 is fitted over the flange 54 and fixed thereto. Between the winding supporting member 55 and the mounting plate 49, a winding 56 constituting an electromagnet together with the iron core 52 is clamped and wounded thereon.

A connecting rod 57 of magnetic material, such as a bolt, is inserted into the hole 50 of the plate 49. The end of the connecting rod 57 is disposed so as to penetrate the winding supporting member 55 in the extending direction thereof and is screw-threadedly connected to the metal fitting 48*b* provided on the extended end of the supporting pole 47*b*.

According to the foregoing embodiment, the operating unit 2 comprises the flange 54 provided on the top portion of the iron core 52 and the winding supporting member 55 of nonmagnetic material fitted into the flange 54 so that it is supported by the flange 54. However, the structure of the operating unit 2 according to the present invention is not limited to that defined by the aforementioned embodiment. For instance, member for supporting a winding of which width is relatively narrow and integrally formed with the iron core 52 may be used for the same purpose.

With respect to the armature member 44 provided on the top end of the iron core 52, it is desirable to form so that its radius is as large as possible. Further, it is desirable to enlarge a top portion of the iron core 52 which constitutes a magnetic path forming part together with the mounting plate 49. In other words, it is necessary to select the mounting position of the metal fitting 48*b* embedded in the supporting pole 47*b* so that the metal fitting 48*b* is away from the top end of the iron core 52 for a predetermined interval in the right direction in FIG. 1. Thus, it is desirable that most of a magnetic flux produced by the electromagnet passes through the iron core 52, the armature member 44, the metal fitting 48*b*, the connecting rod 57, and the mounting plate 49.

Figure 2:
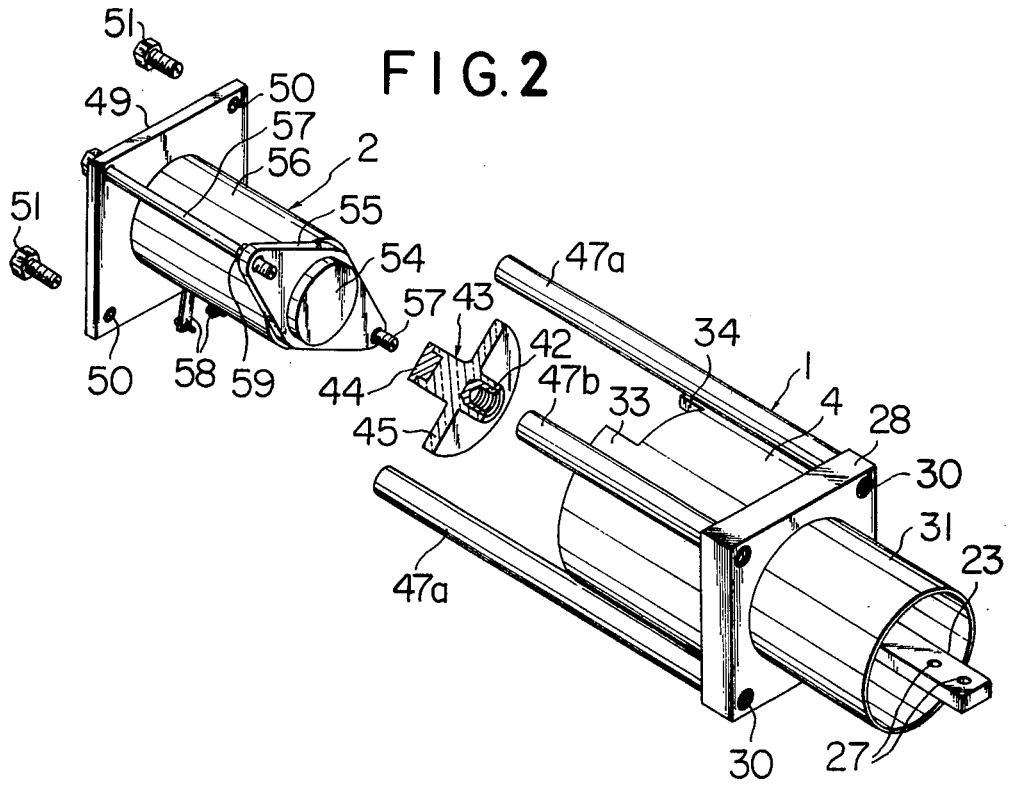
FIG. 2 is an exploded perspective view of the operating device shown in FIG. 1.

In FIGS. 1 and 2, reference numeral 58 denotes a terminal of the winding 56, and reference numeral 59 denotes a lock nut screw-threadedly connected to the end of the connecting rod 57.

Reference is made to a method of mounting the vacuum interrupter to the board-plate. The method comprises the steps of fitting the stationary barrier 31 of the interrupting unit 1 into the board wall 29 of the board-plate, screw-threadedly connecting a clamping tool (not shown) inserted from the inside of the board wall 29 to the metal fitting 30 of the flange 28, and connecting the stationary and movable lead conductors 23 and 36 to the connecting conductors 25 and 40 provided within the board-plate.

In operation, when the winding 56 of the electromagnet within the operating unit 2 is energized in accordance with a command indicative of an opening operation of the vacuum interrupter, the armature member 44 of the insulating rod 43 is absorbed by the iron core 52. As a result, the movable contact rod 17 connected to the insulating rod 43 moves in the left direction in FIG. 1. Thus, the movable electrical contact 9 is away from the stationary electrical contact 8 within the vacuum interrupter 3.

On the contrary, when the winding 56 is deenergized according to a command indicative of an closing operation of the vacuum interrupter, the movable electrical contact 9 is in contact with the stationary electrical contact 8 due to the pressure differential between the inside of the vacuum interrupter 3 and the outside thereof and an elasticity of the bellows 15.

The construction of the electromagnetic operating device according to the present invention is featured as follows:

The supporting block 4 is provided along the outer circumferential surface thereof integrally with a plurality of supporting poles 47*a* and 47*b* disposed in the moving direction of the movable contact rod 17 and extending in the extending direction thereof. The magnetic iron core 52 of the electromagnet on which the winding 56 is winded, and extending in the extending direction of the plurality of supporting poles 47*a* and 47*b* is disposed in the center of the supporting poles. Further, the mounting plate 49 of magnetic material is mounted on the bottom portion of the iron core 52. Further, the electromagnet is supported by connecting rods 57 of magnetic material provided on the mounting plate 49. Furthermore, the insulating rod 43 in which the armature member 44 of a magnetic material is embedded at the position opposite to the top of the iron core is mounted on the movable contact rod.

Accordingly, the present invention makes it possible to effectively incorporate the interrupting unit with the operating unit. As a result, it is possible to eliminate the step required for assembling the operating device into the vacuum interrupter unit, and to make the vacuum interrupting device small-sized. Further, a supporting arrangement for supporting a vacuum interupter constituting the operating device not only serves as a mechanically supporting member, but also does a magnetic path defining member.

Obviously, numerious modifications and variations of the present invention are possible in the light of the above teaching. It is therefore to understood that within the scope of the appended claims, the invention may be practiced otherwise than as specifically described therein.

What is claimed is:

1. An operating device for effecting opening and closing operation of a vacuum interrupter with an electromagnet incorporated therein comprising:

(a) a supporting resin block (4) for supporting a vacuum interrupter, wherein the vacuum interrupter is constituted so that separable electrical contacts are provided within a vacuum vessel through a pair of contact rods so that one is in contact with the other or away therefrom, (b) a first pair of poles **(47*a*) and a second pairs of poles (47*b*) extending along the outer circumferential surface of said supporting resin block (4), the length of said first pair of poles being longer than that of said second pair of poles, said poles constituting each of said pairs having a diagonal relationship about said block, (c) a mounting plate (49) of magnetic material directly connected to said first pair of poles (47*a*) and connected to said second pair of poles (47*b*) through connecting rod means (57), and (d) an electromagnet comprising an iron core (52) and a winding (56) wounded thereon fastened to said mounting plate (49), supported by said first and second pairs of poles and connecting rod means (57), whereby a magnetic path is defined by said iron core (52), said mounting plate (49), and said connecting rod means (57)**.

2. An operating device for effecting opening and closing operation of a vacuum interrupter with an electromagnet incorporated therein as defined in claim 1, which further comprises an armature member (44) of magnetic material for actuation by said electromagnet (52, 56), said armature member (44) being supported by an insulating rod (43) axially joined to the movable contact rod (17), and the arrangement being such that said armature member (44) is in contact with or away from said electromagnet (52, 56) in accordance with the energized and de-energized conditions of said electromagnet (52, 56) to bring the vacuum interrupter (3) into an interrupted condition or a contacts-closed condition.

* * * * *

UNITED STATES PATENT AND TRADEMARK OFFICE

CERTIFICATE OF CORRECTION

PATENT NO. : 4,465,991

DATED : August 14, 1984

INVENTOR(S) : Shinzo Sakuma et al

It is certified that error appears in the above-identified patent and that said Letters Patent is hereby corrected as shown below:

On the title page

Item 73 (assignee data) please insert the following after "Japan": --Kabushiki Kaisha Gemvac, Tokyo, Japan--

Signed and Sealed this

*Twenty-sixth* Day of *March 1985*

[SEAL]

*Attest:*

DONALD J. QUIGG

*Attesting Officer* *Acting Commissioner of Patents and Trademarks*